US006794824B2

(12) United States Patent
Song et al.

(10) Patent No.: US 6,794,824 B2
(45) Date of Patent: Sep. 21, 2004

(54) AUTOMATIC POWER CONTROL (APC) METHOD AND DEVICE OF PLASMA DISPLAY PANEL (PDP) AND PDP DEVICE HAVING THE APC DEVICE

(75) Inventors: Yoo-Jin Song, Cheonan (KR); Joo-Young Lee, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 10/444,114

(22) Filed: May 23, 2003

(65) Prior Publication Data

US 2003/0218432 A1 Nov. 27, 2003

(30) Foreign Application Priority Data

May 24, 2002 (KR) ..... 10-2002-0028963
Jul. 30, 2002 (KR) ..... 10-2002-0044801

(51) Int. Cl.[7] ..... G09G 3/10
(52) U.S. Cl. ..... 315/169.4; 345/63; 345/211
(58) Field of Search ..... 315/167, 169.4, 315/291, 307; 345/41–42, 55, 60, 63, 68, 211–212

(56) References Cited

U.S. PATENT DOCUMENTS

| | | | | |
|---|---|---|---|---|
| 5,541,618 A | | 7/1996 | Shinoda | 345/60 |
| 5,661,500 A | | 8/1997 | Shinoda et al. | 345/60 |
| 5,663,741 A | | 9/1997 | Kanazawa | 345/66 |
| 5,674,553 A | | 10/1997 | Sinoda et al. | 427/68 |
| 5,724,054 A | | 3/1998 | Shinoda | 345/60 |
| 5,786,794 A | | 7/1998 | Kishi et al. | 345/60 |
| 5,952,782 A | | 9/1999 | Nanto | 313/584 |
| 5,956,014 A | * | 9/1999 | Kuriyama et al. | 345/690 |
| 6,025,818 A | * | 2/2000 | Okano | 345/63 |
| RE37,444 E | | 11/2001 | Kanazawa | 345/67 |
| 6,326,938 B1 | * | 12/2001 | Ishida et al. | 345/63 |
| 6,630,916 B1 | | 10/2003 | Shinoda | 345/60 |
| 6,707,436 B2 | | 3/2004 | Setoguchi et al. | 345/60 |
| 6,724,356 B1 | * | 4/2004 | Kojima et al. | 345/60 |

FOREIGN PATENT DOCUMENTS

| | | |
|---|---|---|
| JP | 02-148645 | 6/1990 |
| JP | 2845183 | 10/1998 |
| JP | 2917279 | 4/1999 |
| JP | 2001-043804 | 2/2001 |
| JP | 2001-325888 | 11/2001 |

OTHER PUBLICATIONS

*"Final Draft International Standard"*, Project No. 47C/61988–1/Ed.1; Plasma Display Panels – Part 1:Terminology and letter symbols, published by International Electrotechnical Commission, IEC, in 2003, and Appendix A – Description of Technology, Annex B – Relationship Between Voltage Terms And Discharge Characteristics; Annex C – Gaps and Annex D – Manufacturing.

* cited by examiner

*Primary Examiner*—Thuy Vinh Tran
(74) *Attorney, Agent, or Firm*—Robert E. Bushnell, Esq.

(57) ABSTRACT

Disclosed is an automatic power control (APC) method for a plasma display panel (PDP) including a plurality of address electrodes and a plurality of scan electrodes and sustain electrodes alternately arranged in pairs, which includes: calculating a load ratio change between current input data and previous input data; comparing the calculated load ratio change with a predetermined number of threshold values to determine to which area it belongs; determining a brightness control speed which is a time for applying a new brightness value matched with the determined area; and outputting sustain pulse information corresponding to a load ratio of current data at the determined brightness control speed. Also, the brightness control speed is shortened in the high gray, and it is lengthened in the low gray.

25 Claims, 10 Drawing Sheets

AUTOMATIC POWER CONTROL (APC) METHOD AND DEVICE OF PLASMA DISPLAY PANEL (PDP) AND PDP DEVICE HAVING THE APC DEVICE

CLAIM OF PRIORITY

This application makes reference to, incorporates the same herein, and claims all benefits accruing under 35 U.S.C. § 119 from two applications for AUTOMATIC POWER CONTROL (APC) METHOD AND DEVICE OF PLASMA DISPLAY PANEL (PDP) AND PDP DEVICE HAVING THE APC DEVICE earlier filed in the Korean Intellectual Property Office on May 24, 2002 and there duly assigned Serial No. 2002-28963, and for AUTOMATIC POWER CONTROL (APC) METHOD AND DEVICE OF PLASMA DISPLAY PANEL (PDP) AND PDP DEVICE HAVING THE APC DEVICE earlier filed in the Korean Intellectual Property Office on Jul. 30, 2002 and there duly assigned Serial No. 2002-44801.

BACKGROUND OF THE INVENTION

1. Field of the Invention

The present invention relates to a plasma display panel (PDP) device. More specifically, the present invention relates to an automatic power control (APC) method and device of a PDP, and a PDP device including the APC device.

2. Description of the Related Art

In general, a PDP requires a device for controlling power consumption according to load ratios, since it has high power consumption depending on its driving features. To control the power consumption, an automatic power control (APC) method is employed.

FIG. 1 shows a conventional APC method. As shown, the load ratio axis L has n load ratios $0\sim L_1$, $L_1\sim L_2$, . . . , $L_{n-1}\sim L_n$, and the sustain number axis has predetermined numbers $N_n$, $N_{n-1}$, . . . , $N_1$ matched with the respective n load ratios. For example, the maximum sustain number $N_n$ is applied to the frame that belongs to the minimum load ratio range $0\sim L_1$, and the minimum sustain number $N_1$ is applied to the frame that belongs to the maximum load ratio range $L_{n-1}\sim L_n$.

According to the above-noted conventional power control method, if a video screen is instantly switched, its brightness is severely changed which causes video deterioration.

The APC method includes a fast APC and a slow APC. In the fast APC, power consumption is directly applied to a predetermined APC table stage according to input data to thereby reduce power consumption. In the slow APC, data are applied to a desired APC stage, and the data are slowly lowered to a predetermined APC stage by a predetermined time unit to thereby control the power consumption.

However, since the fast APC forcibly darkens the data from the original brightness so as to reduce the power consumption, a user becomes aware of brightness changes, and the slow APC allows generation of a very large integrated power to the video while greatly changing brightness which cannot be detected by a person, and it also allows an increase in the current stress of a power supply or a PDP driver so as to correspond to peak power consumption. Accordingly, it becomes difficult to design the PDP driver, and prevent heat generation, thereby worsening reliability of components.

FIG. 2 shows a graph for showing conventional slow and fast APC algorithms.

A PDP device controls brightness according to a number of sustain pulses. In the case of a full white screen having high brightness, since the power consumption becomes very high because of a display width and a number of sustain pulses, it is difficult to realize the PDP device. To prevent this problem, input video data are mapped into a predetermined APC table to reduce the number of sustain pulses in advance, and they are displayed to reduce the power consumption.

Referring to FIG. 2, the fast APC processes video data in real-time to reduce the number of sustain pulses and display the video data, and the slow APC displays data with many sustain pulses so as to display the available maximum brightness at the time of initially inputting data, and controls predetermined linear time intervals to a predetermined table value by gradually reducing the number of sustain pulses and reducing the brightness, thereby adjusting the final brightness.

FIG. 3 shows a conventional brightness graph with respect to time.

Referring to FIG. 3, the brightness is steeply changed by abruptly reducing the number of sustain pulses in the desired brightness in the case of the fast APC. A person can sense this abrupt brightness change, which looks like a screen flashing phenomenon.

Differing from this, since the slow APC displays slow brightness changes, the person cannot easily sense the changes. The slow APC improves sensed video quality, but if screens that have great differences of brightness are repeated, a large amount of integrated power is generated as shown in FIG. 2, and hence, the lifetime of the PDP is shortened, it is difficult to design a power supply and a driving board, and many stresses are provided to components, and accordingly, the life span of the corresponding product is decreased.

SUMMARY OF THE INVENTION

It is therefore an object of the present invention to shorten a brightness control speed in the case of high gray with low recognition rate of a person depending on the brightness changes, and lengthen the brightness control speed in the case of low gray with high recognition rate of a person depending on the brightness changes through a predetermined number of inflection points to thereby reduce integrated power and eliminate screen flashing.

It is another object of the present invention to prevent sudden changes of brightness on a PDP screen in a method for controlling a PDP driving power.

In one aspect of the present invention, an automatic power control method for a plasma display panel including a plurality of address electrodes and a plurality of scan electrodes and sustain electrodes alternately arranged in pairs, includes: calculating a load ratio change between current input data and previous input data; comparing the calculated load ratio change with a predetermined number of threshold values to determine to which area it belongs; determining a brightness control speed which is a time for applying a new brightness value matched with the determined area; and outputting sustain pulse information corresponding to a load ratio of current data at the determined brightness control speed.

In another aspect of the present invention, an APC device for a PDP including a plurality of address electrodes and a plurality of scan electrodes and sustain electrodes alternately arranged in pairs, includes: an ASL sensor for measuring a load ratio of external input video signals; a first memory for storing the load ratio of the input video signal data; a second memory for storing information of a number of sustain pulses depending on the load ratio; a power controller for calculating a load ratio change between the current input data and the previous input data stored in the first memory, comparing the calculated load ratio change with a predetermined number of threshold values to determine a brightness control speed which is a time for applying a new brightness value, and outputting sustain information matched with the load ratio at the determined brightness control speed; and a video data processor for correcting and outputting the video signals.

In still another aspect of the present invention, A PDP device includes: a PDP including a plurality of address electrodes and a plurality of scan electrodes and sustain electrodes alternately arranged in pairs; a controller for correcting and outputting external video signals, comparing a load ratio of current input signals with a previous load ratio to calculate a load ratio change, comparing the calculated load ratio change with a predetermined number of threshold values to determine a brightness control speed which is a time for applying a new brightness value, and outputting sustain pulse information matched with the load ratio of the current input video signals at the determined brightness control speed; an address data generator for generating address data corresponding to the correction data output by the controller, and applying them to the address electrodes of the PDP; and a sustain scan pulse generator for respectively generating sustain and scan pulses matched with sustain information, and applying them to the sustain electrodes and the scan electrodes.

The controller corrects and outputs external video signals, separates all load ratio changes into a predetermined number of sections, determines a different brightness control speed for each separated section, stores the same, determines to what stage the load ratio of the current input video signals belongs to determine a brightness control signal which is a time for applying a new brightness value according to the load ratio, and outputs sustain pulse information matched with the load ratio of the current data at the determined brightness control speed.

In still yet another aspect of the present invention, an APC method for a PDP including a plurality of address electrodes and a plurality of scan electrodes and sustain electrodes alternately arranged in pairs, includes: separating all load ratios into a predetermined number of sections, allocating different brightness control speeds to the sections, and storing the brightness control speeds in a table; calculating a load ratio of current input data; determining to what section the calculated load ratio belongs, and determining the brightness control speed which is a time for applying a new brightness value, the brightness control speed being determined according to the section to which the load ratio belongs; and outputting sustain pulse information matched with the load ratio of current data at the determined brightness control speed.

In still further another aspect of the present invention, an APC device for a PDP including a plurality of address electrodes and a plurality of scan electrodes and sustain electrodes alternately arranged in pairs, includes: a memory for separating a load ratio into a plurality of sections, determining a different brightness control speed which is a time for applying a new brightness value according to the load ratio for each section, and storing the same; an ASL sensor for measuring a load ratio of externally input video signals; and a power controller for determining a brightness control speed depending on the load ratio of the current input data with reference to the memory, and outputting sustain information matched with the current load ratio at the determined brightness control speed.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Figure 1:
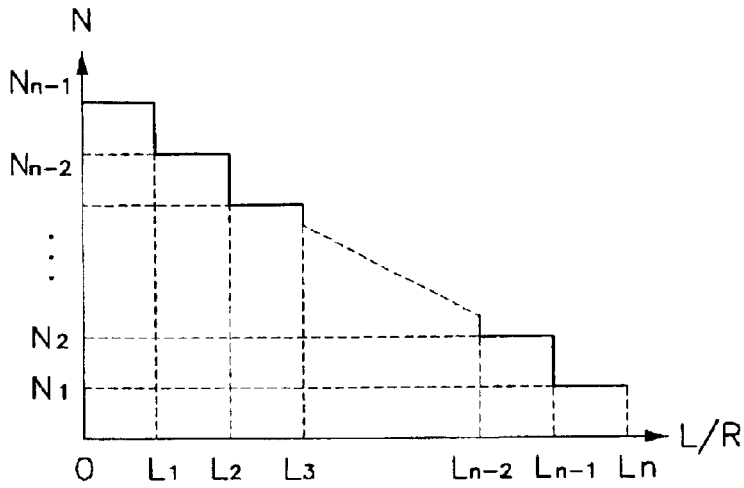
FIG.1 (Prior Art)
FIG. 1 shows a conventional APC method.
Figure 2:
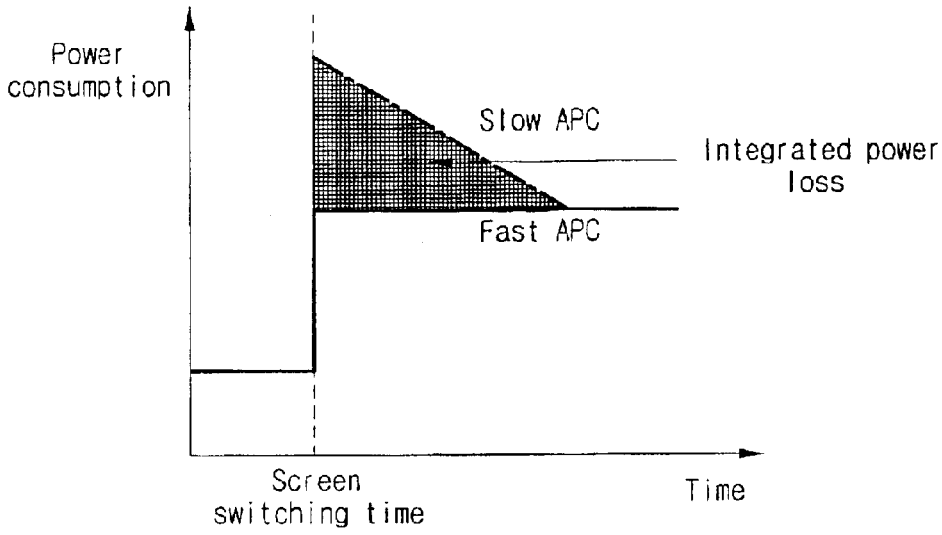
FIG.2 (Prior Art)
FIG. 2 shows a graph for showing conventional slow and fast APC algorithms.
Figure 3:
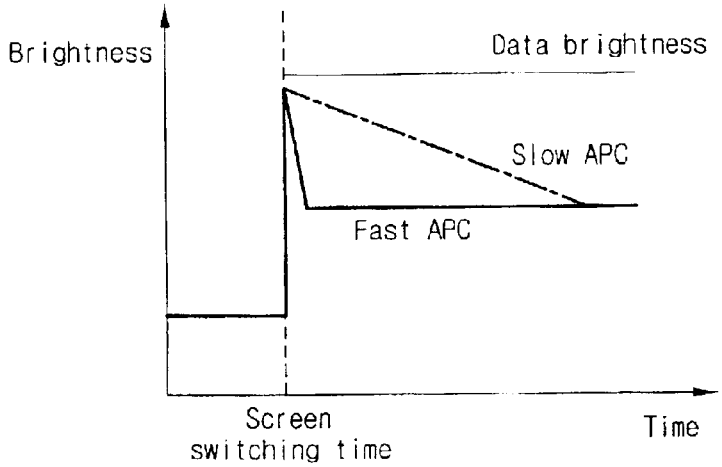
FIG.3 (Prior Art)
FIG. 3 shows a conventional brightness graph with respect to time.
Figure 4:
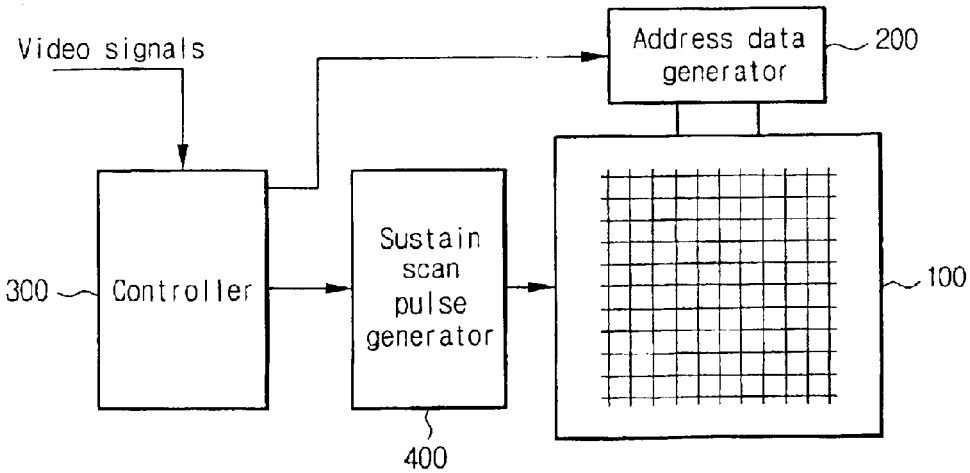
FIG. 4 shows a configuration of a PDP device according to a preferred embodiment of the present invention.

FIG. 4 shows a configuration of a PDP device according to a preferred embodiment of the present invention.

Referring to FIG. 4, the PDP device includes a PDP 100, a controller 300, an address data generator 200, and a sustain scan pulse generator 400.

The PDP 100 includes, but is not limited to, a plurality of address electrodes, and a plurality of scan electrodes and sustain electrodes alternately arranged in pairs.

The controller 300 corrects and outputs external video signals, compares a load ratio of currently input video signals with a previous load ratio to calculate a load ratio change, compares the calculated load ratio change with a predetermined number of threshold values to determine a brightness control speed which is a time to which a new brightness value is applied, and outputs sustain pulse information corresponding to the load ratio of the currently input video signals using the determined brightness control speed. In this instance, the controller 300 corrects and outputs the external video signals, divides all the load ratio changes into a predetermined number of units, differently sets the brightness control speeds of the respective divided units to store them in a table, determines to which stage the load ratio of the currently input video signals belong to determine the brightness control speed which is a time for applying a new brightness value according to the load ratio, and outputs sustain pulse information matched with the load ratio of the current data in the determined brightness control speed, or concurrently performs the above two controls.

The address data generator 200 generates address data corresponding to correction data output by the controller 300 to supply the correction data to the address electrodes of the PDP. The sustain scan pulse generator 400 generates respective sustain pulses and scan pulses matched with sustain information provided by the controller 300, and supplies them to the sustain electrodes and the scan electrodes.

Figure 5:
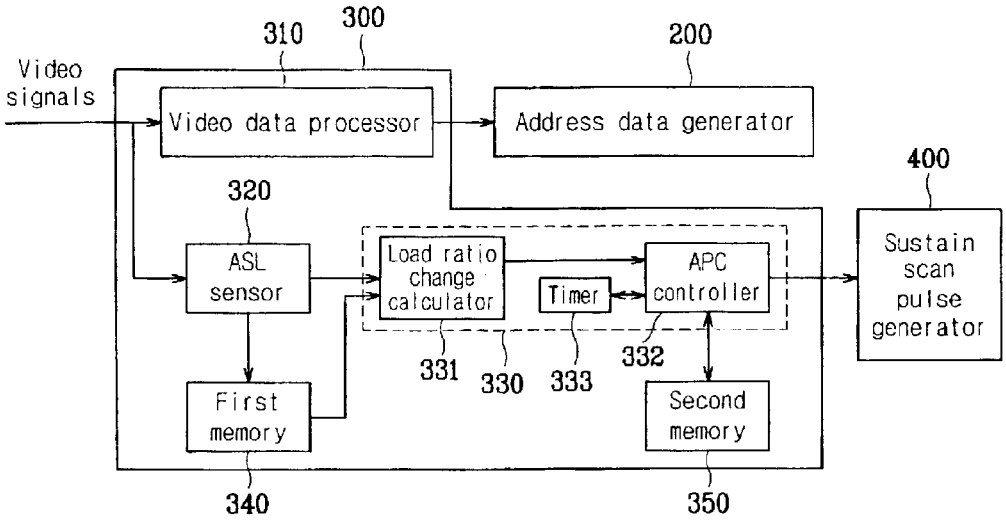
FIG. 5 shows a configuration of a controller of FIG. 4.
Figure 6:
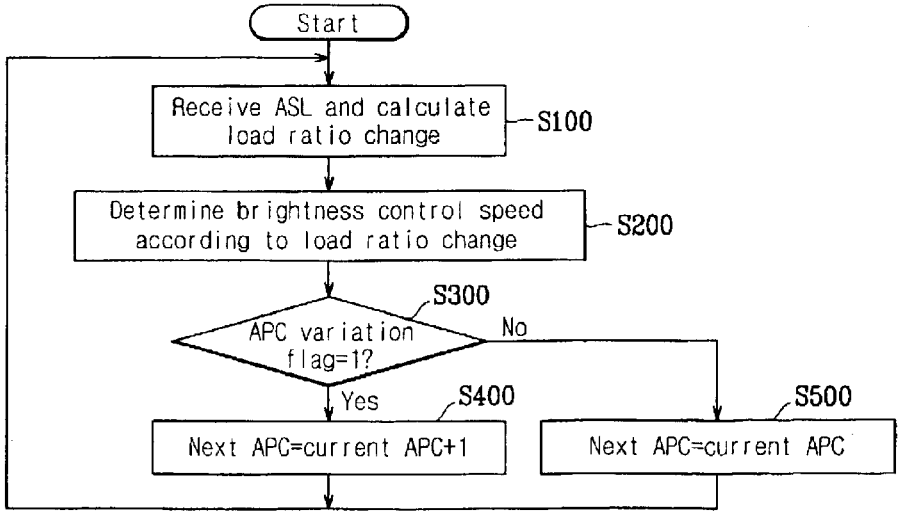
FIG. 6 shows a flowchart of an APC method of a PDP according to a first preferred embodiment of the present invention.

FIG. 5 shows a configuration of the controller of FIG. 4.

Referring to FIG. 5, the controller 300 includes a video data processor 310, a power controller 330, an average signal level (ASL) sensor 320, a first memory 340, and a second memory 350.

The video data processor 310 corrects and outputs video signals. The first memory 340 stores load ratios of previous frames. The second memory 350 stores information of a number of sustain pulses depending on the load ratio. The ASL sensor 320 measures the load ratio of the externally input video signals, and stores the same in the first memory 340. The power controller 330 calculates a load ratio change between the currently input data and previous input data, compares the calculated load ratio change with a predetermined number of threshold values to determine a brightness control speed which is a time for applying a new brightness value, and outputs sustain information matched with the current load ratio using the determined brightness control speed.

An APC method and device for a PDP, and an operation of a PDP device including the APC device, will now be described in detail.

First, when externally receiving video signals including data components R (red), G (green), and B (blue) and sync signals Hsync (horizontal synchronization signal) and Vsync (vertical synchronization signal), the video data processor 310 corrects the data components R, G, and B to have an identical brightness level.

The ASL sensor 320 measures an ASL of the data components R, G, and B, and provides the ASL to the power controller 330 and the first memory 340.

A load ratio change calculator 331 of the power controller 330 calculates a load ratio change using the load ratio currently measured by the ASL sensor 320 and the load ratio of the previous input data stored in the first memory 340 in step S100.

In this instance, the load ratio change may be calculated by comparing the load ratio of the current single frame with a previous single frame or an average value of a plurality of frames, if necessary.

Next, an APC controller 332 determines to which range of the plural threshold values the calculated load ratio change belongs, and sets a brightness control speed which is a time at which a new brightness value is set in step S200.

Figure 7:
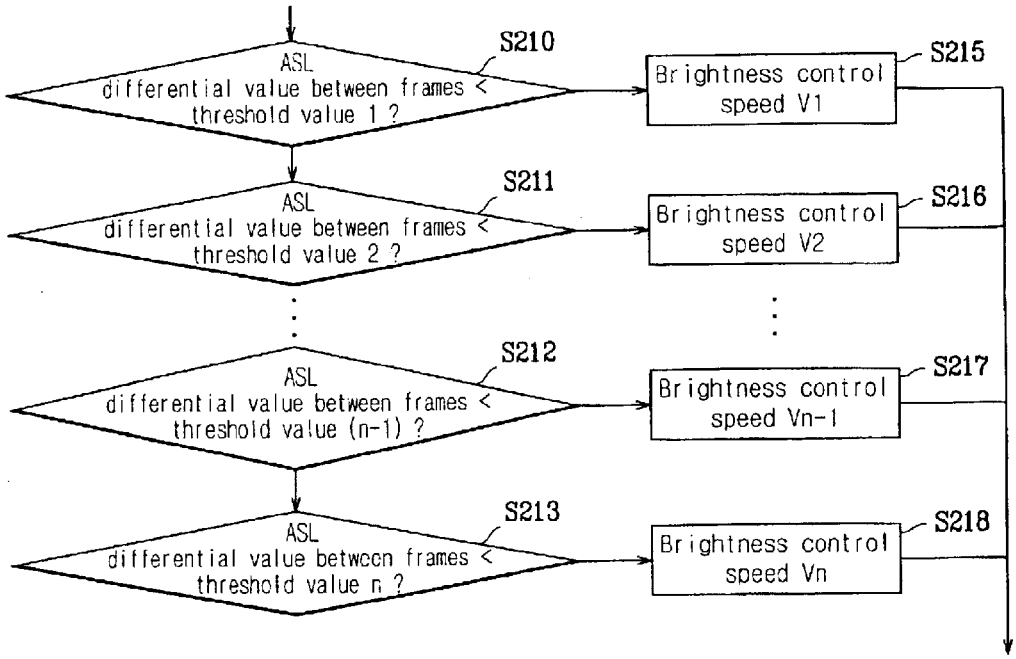
FIG. 7 shows a detailed flowchart for determining a brightness control speed.

A process for setting the brightness control speed will now be described with reference to FIG. 7.

When the load ratio change which is a differential value of the ASL between the frames is less than a threshold value '1' in step S210, the brightness control speed is set to be V1 in step S215; when it is less than a threshold value '2' in step S211, the brightness control speed is set to be V2 in step S216; when it is less than a threshold value 'n−1' in step S212, the brightness control speed is set to be Vn−1 in step S217; and when it is less than a threshold value 'n' in step S213, the brightness control speed is set to be Vn in step S218.

As described above, the load ratio change is divided into n intervals, and the brightness control speed is also divided into n sections to thereby determine a brightness control speed of the corresponding load ratio change. In this instance, the brightness control speed is controlled to be faster as the load ratio change becomes greater, the most appropriate values caused by the experiments are applied if needed, and the load ratio change is in proportion to the brightness control speed.

When the brightness control speed is determined as described above, a timer 333 checks time until it reaches the brightness control speed, and when it becomes the corresponding brightness control speed, the timer 333 sets an APC variation flag in the APC controller 332 to be '1' in step S300.

The APC controller 332 outputs sustain pulse information corresponding to the current load ratio to modify the current APC stage to a next APC stage by one stage in step S400.

When the time does not reach the brightness control speed and the APC variation flag is not set to be '1,' the APC controller 332 does not output sustain pulse information matched with the current load ratio, but sustains the next APC stage as the current APC stage in step S500.

Here, the APC controller 332 modifies the APC stages in the SOA (safety operating area) which will now be described in detail.

Figure 8:
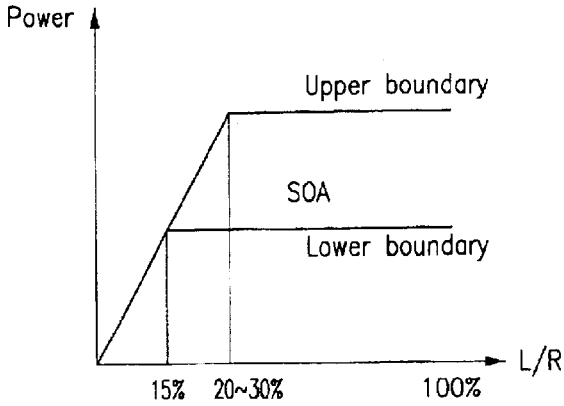
FIG. 8 shows a power graph according to load ratios according to a preferred embodiment of the present invention.

FIG. 8 shows a graph of power consumed according to the load ratio, indicating that the power is controlled in the SOA. Referring to FIG. 8, the SOA is controlled to have the load ratio of the upper reference value be 20 through 30%, and the load ratio of the lower reference value be 15% when the power consumption is 500W (watts).

Figure 9:
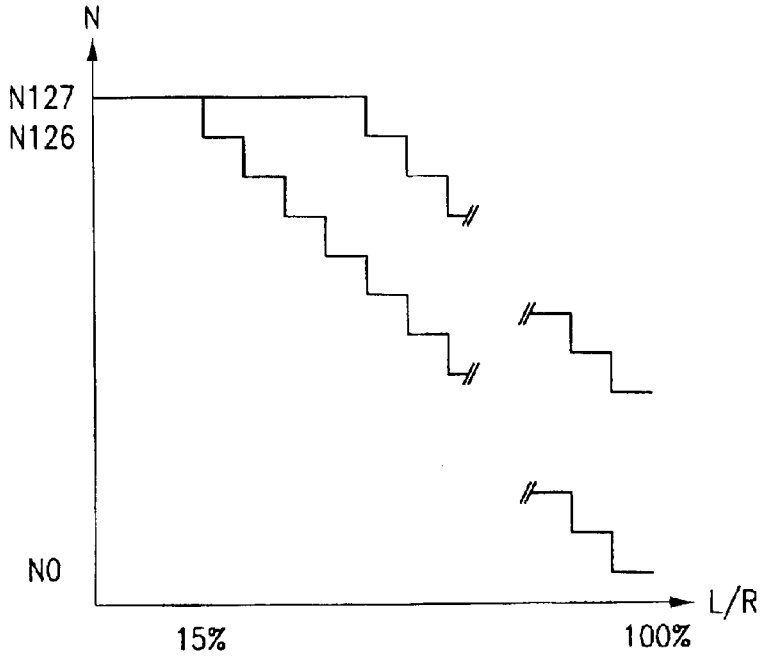
FIG. 9 shows a graph for a number of sustain pulses according to load ratios according to a preferred embodiment of the present invention.

FIG. 9 shows an algorithm applied to the APC controller. Referring to FIG. 9, the whole range of the load ratio L/R covers 100%, and the number of sustaining N0, N2, . . . , N127 corresponding to the respective load ratios is set.

When the load ratio at the current frame, that is, the ASL is instantly increased in the video, the number of sustain pulses is slowly reduced, and accordingly, the brightness is slowly reduced.

Also, when the ASL is abruptly reduced because of screen switching, and the load ratio digresses from the SOA, the number of sustain pulses directly moves to the lower reference value corresponding to the reduced ASL to display its brightness.

That is, when the load ratio digresses from the SOA while sustaining the number of sustain pulses when the current load ratio is changed, the number of sustain pulses is controlled to be the lower or upper reference value. The number of sustain pluses is controlled to be the upper reference value when the load ratio increases, and the number is controlled to be the lower reference value when the load ratio decreases.

When the ASL is less changed, the number of sustain pulses corresponding to the existing load ratio is applied. That is, in the case the previous number of sustain pulses is sustained when the load ratio changes in the SOA, the number of sustain pulses is set to sustain the preset APC stage for a predetermined time and reach the lower reference value.

That is, the number of sustaining according to the load ratio stored in the second memory 350 slowly reaches the lower reference value from the upper reference value in the SOA according to the load ratio.

Through this process, the APC controller 332 outputs sustain information matched with the current load ratio to the sustain scan pulse generator 400 at the brightness control speed.

The sustain scan pulse generator 400 receives the sustain information, brings the number of sustain pulses corresponding to the load ratio from the second memory 350 at the corresponding brightness control speed to respectively generate sustain and scan pulses, and applies them to the sustain and scan electrodes.

The address data generator 200 generates address data matched with correction data output by the video data processor 310, and applies them to the address electrode lines. The PDP 100 then displays the video data.

As described, the time to which the new brightness is applied is shortened when the load ratio is greatly varied, and the time is lengthened when the load ratio is less varied, thereby reducing the integrated power compared to prior art.

Figure 10:
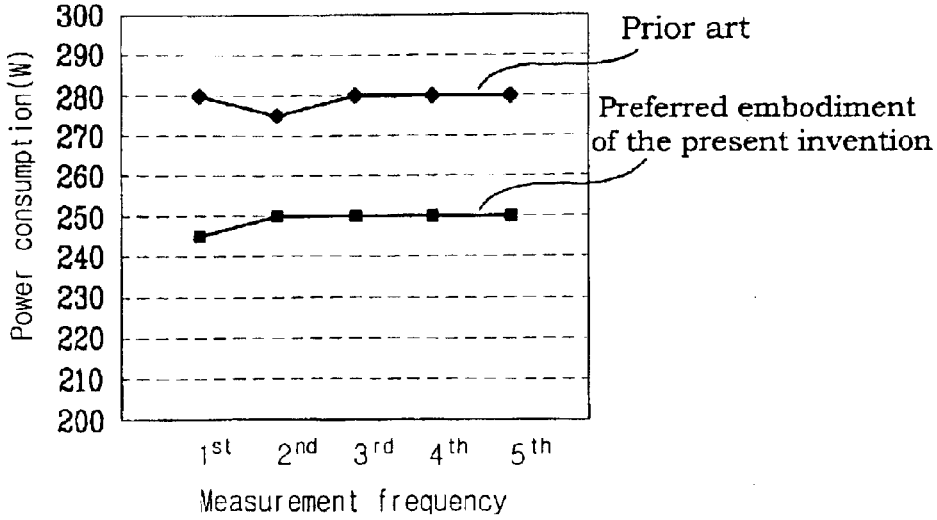
FIG. 10 shows a graph for measured results of power consumption through experiments according to prior art and a preferred embodiment of the present invention.

FIG. 10 shows values measured through actual experiments for showing saving of power consumption.

Referring to FIG. 10, it is shown that the integrated power is substantially reduced. In this instance, measuring instruments include an analog power measure instrument, a power consumption instrument, and a CA-100; a measured target panel is a 42-inch S1.0 panel; and a measuring condition is application of gamma error diffusion to the panel for an hour.

In the preferred embodiment, the PDP device uses a difference value of ASLs between the current and previous frames so as to determine the brightness control speed.

Figure 11:
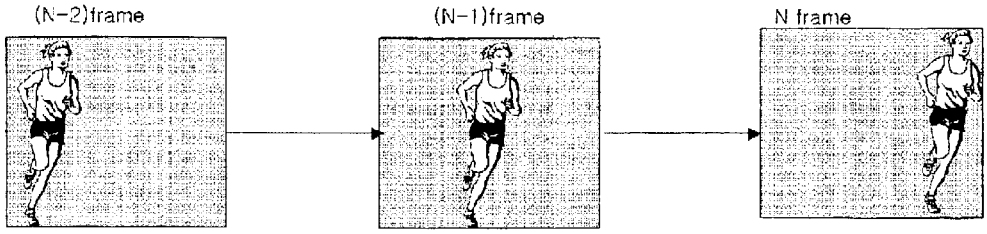
FIG. 11 shows a method for a controller to measure load ratios according to a first preferred embodiment of the present invention.

The above-noted calculation method may possibly, however, provide some erroneous information to a predetermined screen. FIG. 11 shows three sequential frames with respect to time in moving pictures. Referring to FIG. 11, the screens are actually being changed, but the difference between the frames is zero.

Figure 12:
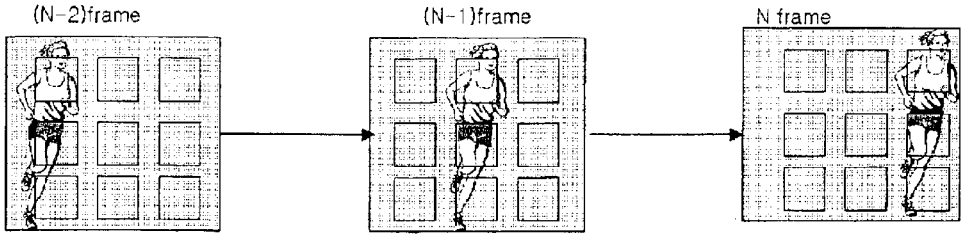
FIG. 12 shows a method for a controller to measure load ratios according to a second preferred embodiment of the present invention.

Therefore, in order to reduce errors that are generated by use of an ASL difference between the current and previous frames, a single frame is divided into a predetermined number of blocks, and a differential value of the ASL of each block may be used. FIG. 12 shows a method for allocating nine blocks.

Figure 13:
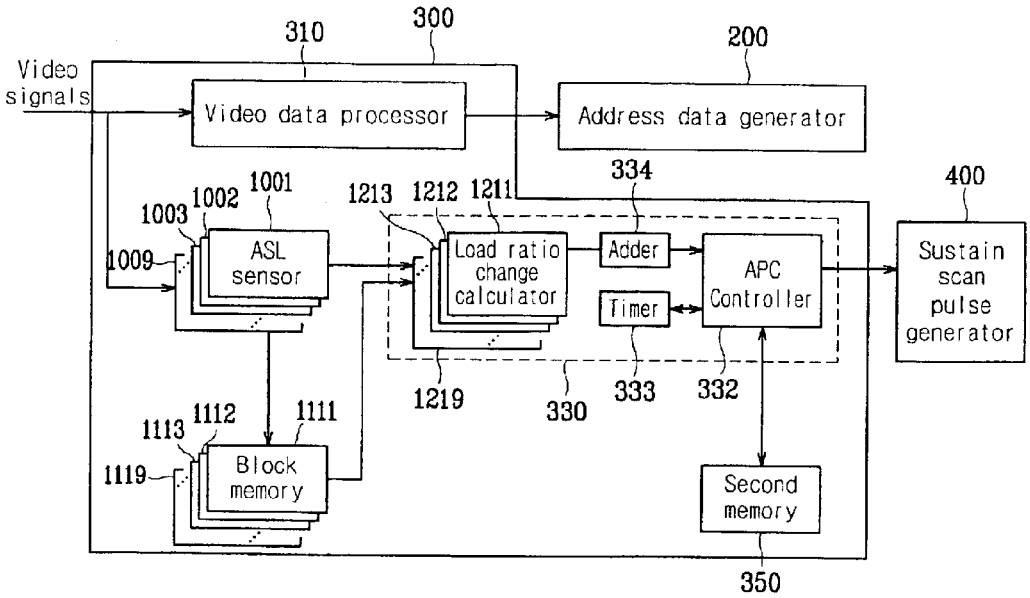
FIG. 13 shows a configuration of a controller according to a second preferred embodiment of the present invention.

Referring to FIG. 12, a frame is divided into nine blocks, and an ASL difference between a current frame and a previous frame is calculated for each block, and hence, a predetermined difference value between the frames is generated. FIG. 13 shows a configuration of the controller 300 to which the method of FIG. 12 is applied according to a second preferred embodiment of the present invention.

Referring to FIG. 13, the controller 300 includes a video data processor 310, a power controller 330, ASL sensors 1001 through 1009, block memories 1111 through 1119, and a second memory 350.

The video data processor 310 corrects and outputs video signals. Nine block memories 1111 through 1119 store load ratios of previous frames. The second memory 350 stores information of a number of sustain pulses depending on the load ratios. Nine ASL sensors 1001 through 1009 measure the load ratio of externally input video signals for each block, and respectively store the same in the block memories 1111 through 1119. The power controller 330 calculates load ratio changes between current input data and previous input data for each block, adds them, compares the added load ratio changes with a predetermined number of threshold values to determine a brightness control speed which is a time for applying a new brightness value, and outputs sustain information matched with the current load ratio at the determined brightness control speed.

The power controller 330 includes: nine load ratio change calculators 1211 through 1219 for respectively calculating a load ratio change between the current input data and the previous input data for each block; an adder 334 for adding the nine load ratio changes; an APC controller 332 for comparing the load ratio changes added by the adder 334 with a predetermined number of threshold values to determine a brightness control speed for applying a new brightness value, and outputting sustain information matched with the current load ratio at the determined brightness control speed; and a timer 333 for calculating time.

In this instance, the controller 300 according to the second preferred embodiment of the present invention includes nine ASL sensors 1001 through 1009, nine load ratio change calculators 1211 through 1219, nine block memories 1111 through 1119, and an adder 334 for adding the nine load ratio changes. Since other components are identical with those in the previous preferred embodiment of the present invention, identical reference numerals are given to them.

Segmentation into nine blocks represents an exemplified case, and it may be variously modified.

The operations of the second preferred embodiment are very similar to those of the previous preferred embodiment, and the ASL sensors 1001 through 1009 sense the load ratios of the respective corresponding blocks shown in FIG. 12, and store them in the load ratio change calculators 1211 through 1219 and the block memories 1111 through 1119.

The load ratio change calculators 1211 through 1219 respectively calculate the load ratio changes between the current input data of each block and the previous input data, and output them.

The adder 334 adds the respective load ratio changes output by the load ratio change calculators 1211 through 1219, and outputs them.

The APC controller 332 compares the added load ratio change with a predetermined number of threshold values to determine a brightness control speed which is a time for applying a new brightness value, and outputs sustain information matched with the current load ratio at the determined brightness control speed.

Since the load ratios are calculated for each block in the second preferred embodiment of the present invention, it may treat minute changes of the screen.

Figure 14:
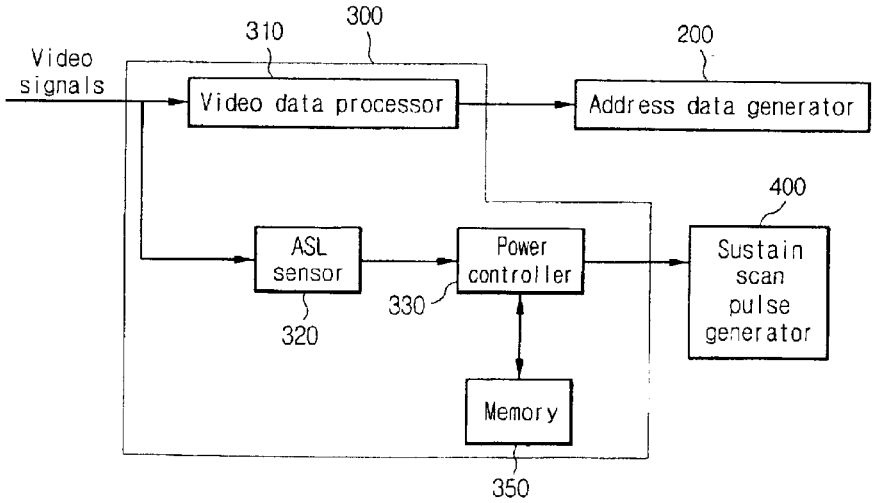
FIG. 14 shows a configuration of a controller according to a third preferred embodiment of the present invention.

FIG. 14 shows an internal configuration of the controller of FIG. 4 according to a third preferred embodiment of the present invention. Referring to FIG. 14, the controller 300 includes a video data processor 310, a power controller 330, an ASL sensor 320, and a memory 350.

The video data processor 310 corrects and outputs video signals. The memory 350 separates a load ratio into a predetermined number of sections, differently sets a brightness control speed which is information on the time at which a new brightness value is applied according to the load ratio for each section, stores it, and stores information of a number of sustain pulses matched with the load ratio. The ASL sensor 320 measures the load ratio of the externally input video signals. The power controller 330 determines the brightness control speed according to the load ratio of the current input data with reference to the memory, and outputs sustain information corresponding to the current load ratio at the determined brightness control speed.

An APC method and device for a PDP, and an operation of the APC device according to the third preferred embodiment of the present invention, will now be described in detail.

First, when externally receiving video signals including data components R, G, and B and sync signals Hsync and Vsync, the video data processor 310 corrects the data components R, G, and B to have an identical brightness level.

The ASL sensor 320 measures an ASL of the data components R, G, and B, and provides it to the power controller 330.

The power controller 330 determines to what section of the load ratio stored in the memory 350 the load ratio currently measured by the ASL sensor 320 belongs. In this instance, the time for applying a new brightness value is differentiated according to the section of the load ratio as shown in FIG. 15.

Figure 15:
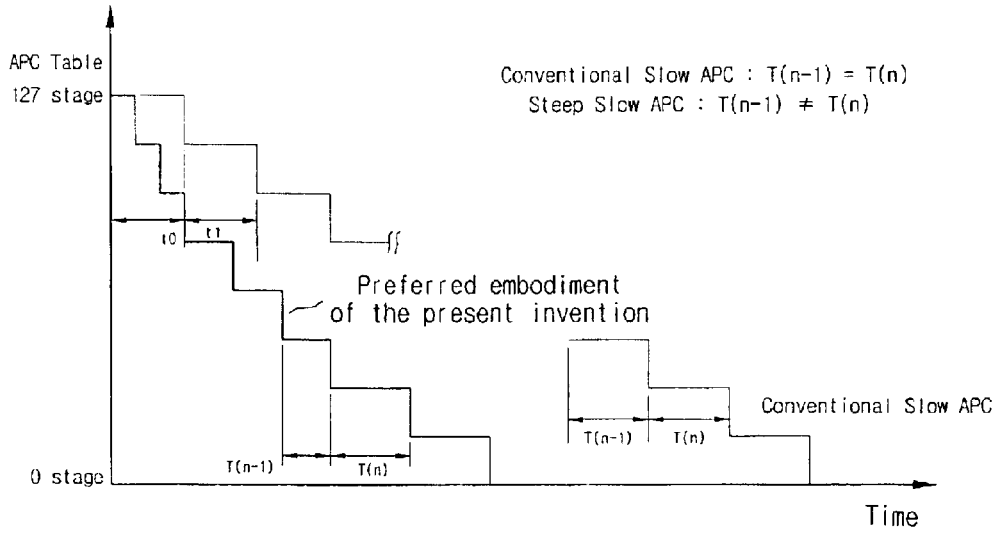
FIG. 15 shows brightness control speeds of a controller according to load ratios according to a third preferred embodiment of the present invention.

Referring to FIG. 15, new brightness values are conventionally applied to 127 stages of the load ratio with equal time intervals, but a different time is applied to each stage in the preferred embodiment. That is, the existing APC look up table with equal time intervals is modified to an APC lookup table having an assigned inflection point.

Next, the power controller 350 brings a brightness control speed of the interval to which the load ratio change belongs from the memory 350. In this instance, the memory 35 stores different brightness control speeds according to intervals as shown in FIG. 15, and the number of the intervals may be varied if needed. Here, the brightness control speed represents a time used for applying a new brightness value while performing brightness control on the load ratio of the current frame.

The power controller 350 outputs sustain information corresponding to the current load ratio to the sustain scan pulse generator 400 at the determined brightness control speed.

The sustain scan pulse generator 400 receives the sustain information, and brings a number of the sustain pulses corresponding to the load ratio from the memory 350 at the corresponding brightness control speed to respectively generate sustain pulses and scan pulses, and applies them to the sustain and scan electrodes, respectively.

The address data generator 200 generates address data corresponding to the correction data output by the video data processor 310, and applies them to the address electrode lines.

The PDP 100 then displays video data.

By shortening the time for applying the new brightness value in the high gray at which a recognition rate by a person depending on the brightness changes is low, and lengthening the time in the low gray at which the recognition rate is high, the integrated power is reduced and the screen flash is eliminated compared to the prior art, which will be described in further detail.

Figure 16:
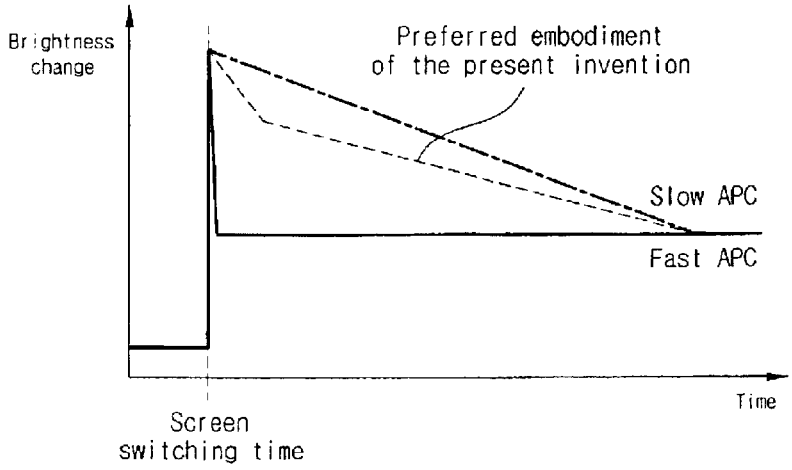
FIG. 16 shows brightness changes of a controller with respect to time according to a third preferred embodiment of the present invention.

FIG. 16 shows brightness changes with respect to time.

Referring to FIG. 16, when the brightness change according to the APC is greater than a predetermined load ratio in the case of the fast APC, the brightness change has the brightness of the upper limit, and the brightness falls to the brightness desired by a consumer, thereby generating screen flashing, but since the slow APC outputs the brightness of as much as a desired degree, and reduces the brightness slowly and linearly, the consumer is adapted to the brightness and rarely senses the changes of the brightness. The APC according to the preferred embodiment of the present invention makes the initial brightness attenuation very fast when the load ratio is very large, and allows it to have a predetermined inflection point, and accordingly, as time passes, the changes of the brightness becomes slower than the slow APC, and hence the consumer rarely detects the brightness changes. Accordingly, the preferred embodiment compensates for the steep brightness change which is the fast APC's biggest demerit, and reduces the power consumption.

Figure 17:
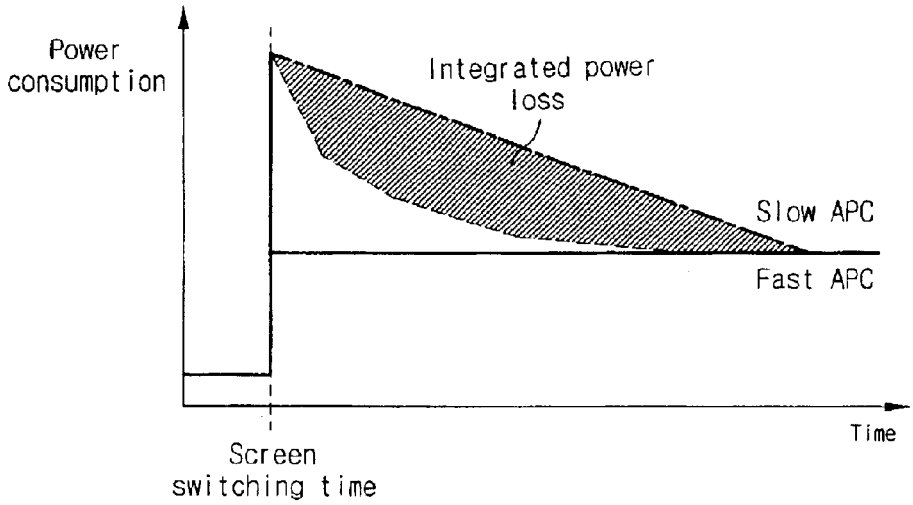
FIG. 17 shows power consumption of a controller with respect to time according to a third preferred embodiment of the present invention.

FIG. 17 shows power consumption with respect to time, comparing the APC of prior art with that of the preferred embodiment of the present invention. Referring to FIG. 17, since the APC application case according to the preferred embodiment of the present invention has less brightness changes than the fast APC, it supplements inferior sensibility screens because of a person's low recognition of the brightness changes, and it reduces power compared to the slow APC to prevent increase of the integrated power. The brightness control speed can separate all load ratios into for example four sections so that a curve of time versus power consumption may have three inflection points.

The present invention can be realized as computer-executable instructions stored in computer-readable media. The computer-readable media includes all possible kinds of media in which computer-readable data is stored or included or can include any type of data that can be read by a computer or a processing unit. The computer-readable media include for example and not limited to storing media, such as magnetic storing media (e.g., ROMs, floppy disks, hard disk, and the like), optical reading media (e.g., CD-ROMs (compact disc-read-only memory), DVDs (digital versatile discs), re-writable versions of the optical discs, and the like), hybrid magnetic optical disks, organic disks, system memory (read-only memory, random access memory), non-volatile memory such as flash memory or any other volatile or non-volatile memory, other semiconductor media, electronic media, electromagnetic media, infrared, and other communication media such as carrier waves (e.g., transmission via the Internet or another computer). Communication media generally embodies computer-readable instructions, data structures, program modules or other data in a modulated signal such as the carrier waves or other transportable mechanism including any information delivery media. Computer-readable media such as communication media may include wireless media such as radio frequency, infrared microwaves, and wired media such as a wired network. Also, the computer-readable media can store and execute computer-readable codes that are distributed in computers connected via a network. The computer readable medium also includes cooperating or interconnected computer readable media that are in the processing system or are distributed among multiple processing systems that maybe local or remote to the processing system. The present invention can include the computer-readable medium having stored thereon a data structure including a plurality of fields containing data representing the techniques of the present invention.

Figure 18:
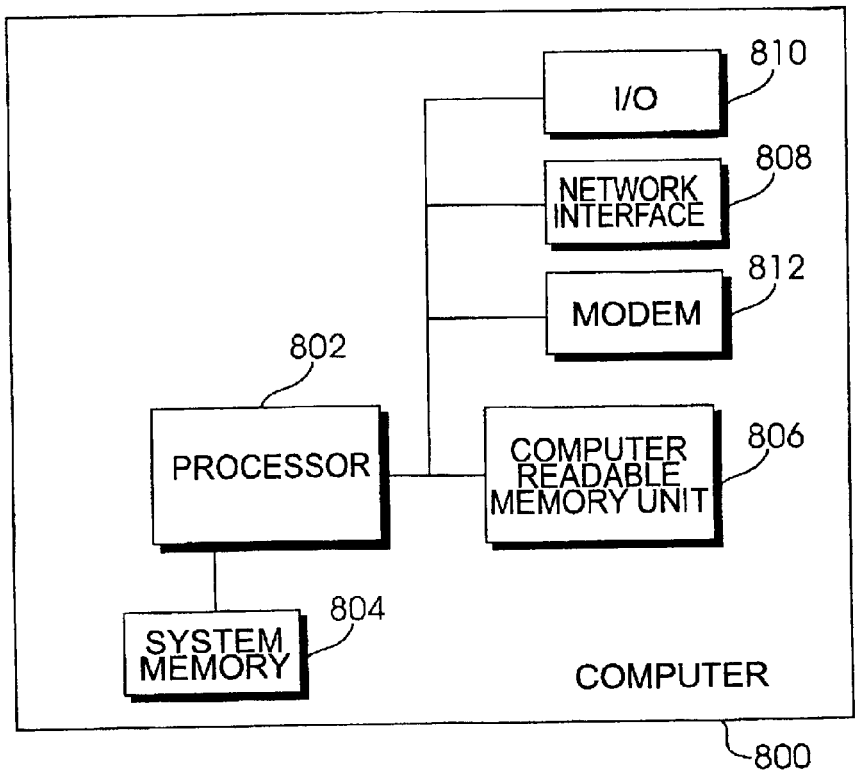
FIG. 18 shows an example of a computer including a computer-readable medium having computer-executable instructions for performing a method of automatic power control for a plasma display panel of the present invention.

An example of a computer, but not limited to this example of the computer, that can read computer readable media that includes computer-executable instructions of the present invention is shown in FIG. 18. The computer 800 includes a processor (central processing unit) 802 that controls the computer 800. The processor 802 uses the system memory 804 and a computer readable memory device 806 that includes certain computer readable recording media. A system bus connects the processor 802 to a network interface 808, modem 812 or other interface that accommodates a connection to another computer or network such as the Internet. The system bus may also include an input and output interface 810 that accommodates connection to a variety of other devices.

As described above, the integrated power is reduced and screen flashing is eliminated by shortening the application time of the APC table in the high gray where human recognition according to the brightness changes is low, and lengthening it in the low gray where the recognition is high.

Also, the power consumption is reduced by differently applying the brightness control speed which is the time for applying a new brightness value according to load ratio changes.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. An automatic power control method for a plasma display panel including a plurality of address electrodes and a plurality of scan electrodes and sustain electrodes alternately arranged in pairs, comprising:

calculating a load ratio change between current input data and previous input data;

comparing the calculated load ratio change with a predetermined number of threshold values to determine to which area it belongs;

determining a brightness control speed which is a time for applying a new brightness value matched with the determined area; and outputting sustain pulse information corresponding to the load ratio of current data at the determined brightness control speed.

2. The automatic power control method of claim 1, wherein determining the brightness control speed comprises: making a new brightness control speed faster as the load ratio change becomes greater.

3. The automatic power control method of claim 1, wherein calculating the load ratio change comprises: separating the current input data into a plurality of blocks, calculating a load ratio change for each block, and adding the calculated load ratio changes.

4. The automatic power control method of claim 3, wherein outputting the sustain pulse information comprises: setting an upper reference value and a lower reference value of a whole range of a number of the sustain pulses, making the number of sustain pulses reach the lower reference value within the range, and when the load ratio sustains the number of previous sustain pulses and it digresses from a safety operating area, setting the number of sustain pulses to reach the upper reference value in the case the load ratio is increased, and setting the number to reach the lower reference value in the case the load ratio is decreased.

5. The automatic power control method of claim 1, further comprising: respectively generating sustain and scan pulses matched with the sustain pulse information, and applying the sustain and scan pulses to the sustain and scan electrodes.

6. An automatic power control device for a plasma display panel including a plurality of address electrodes and a plurality of scan electrodes and sustain electrodes alternately arranged in pairs, comprising:

an average signal level sensor for measuring a load ratio of external input video signals;

a first memory for storing the load ratio of the external input video signals;

a second memory for storing information of a number of sustain pulses depending on the load ratio;

a power controller for calculating a load ratio change between current input data and previous input data stored in the first memory, comparing the calculated load ratio change with a predetermined number of threshold values to determine a brightness control speed which is a time for applying a new brightness value, and outputting sustain information matched with the load ratio at the determined brightness control speed; and a video data processor for correcting and outputting the video signals.

7. The automatic power control device of claim 6, wherein the power controller comprises:

a load ratio change calculator for calculating the load ratio change between the current input data and previous the input data; and an automatic power control controller for determining the brightness control speed matched with the load ratio change, and outputting sustain information corresponding to the current load ratio at the determined brightness control speed.

8. The automatic power control device of claim 7, wherein the automatic power control controller makes the brightness control speed faster as the load ratio change becomes greater.

9. The automatic power control device of claim 8, wherein the automatic power control controller sets an upper reference value and a lower reference value of a whole range of a number of the sustain pulses, makes the number of sustain pulses reach the lower reference value within the range, and when the load ratio sustains the number of previous sustain pulses and it digresses from a safety operating area, the automatic power control controller sets the number of sustain pulses to reach the upper reference value a case the load ratio is increased, and sets the number of sustain pulses to reach the lower reference value in a case the load ratio is decreased.

10. An automatic power control device for a plasma display panel, comprising:

an average signal level sensor for separating a load ratio of externally input video signals into a plurality of blocks, and measuring the plurality of blocks;

a plurality of block memories for respectively storing the load ratios output by the average signal level sensor;

a second memory for storing information of a number of sustain pulses depending on the load ratio;

a power controller for respectively calculating a load ratio change between the blocks of current input data and a load ratio change of previous input data stored in the block memories, adding the calculated load ratio changes, comparing the added load ratio change with a predetermined number of threshold values to determine a brightness control speed which is a time for applying a new brightness value, and outputting sustain information matched with the current load ratio at the determined brightness control speed; and a video data processor for correcting and outputting the video signals.

11. The automatic power control device of claim 10, wherein the power controller comprises:

a load ratio change calculator for respectively calculating the load ratio change between the current input data and the previous input data for each block;

an adder for adding the calculated load ratio changes;

an automatic power control controller for comparing the load ratio change added by the adder with the predetermined number of threshold values to determine the brightness control speed which is the time for applying the new brightness value, and outputting the sustain information matched with the current load ratio at the determined brightness control speed; and a timer used for measuring the brightness control speed.

12. A plasma display panel device comprising:

a plasma display panel including a plurality of address electrodes and a plurality of scan electrodes and sustain electrodes alternately arranged in pairs;

a controller for correcting and outputting external video signals, comparing a load ratio of current input signals with a previous load ratio to calculate a load ratio change, comparing the calculated load ratio change with a predetermined number of threshold values to determine a brightness control speed which is a time for applying a new brightness value, and outputting sustain pulse information matched with the load ratio of the current input video signals at the determined brightness control speed;

an address data generator for generating address data corresponding to the correction data output by the controller, and applying them to the address electrodes of the plasma display panel; and a sustain scan pulse generator for respectively generating sustain and scan pulses matched with sustain information, and applying the sustain and scan pulses matched with sustain pulse information to the sustain electrodes and the scan electrodes.

13. The plasma display panel device of claim 12, wherein the controller comprises:

an average signal level sensor for separating a load ratio of externally input video signals into a plurality of blocks, and measuring the plurality of blocks;

a plurality of block memories for respectively storing the load ratios output by the average signal level sensor;

a second memory for storing information of a number of sustain pulses depending on the load ratio;

a power controller for respectively calculating a load ratio change between blocks of current input data and a load ratio change of previous input data stored in the block memories, adding the calculated load ratio changes, comparing the added load ratio change with predetermined number of threshold values to determine the brightness control speed which is the time for applying the new brightness value, and outputting the sustain information matched with the current load ratio at the determined brightness control speed; and a video data processor for correcting and outputting the video signals.

14. The plasma display panel device of claim 12, wherein the controller comprises:

an average signal level sensor for measuring a load ratio of external input video signals;

a first memory for storing the load ratio of the external input video signals;

a second memory for storing information of a number of sustain pulses depending on the load ratio;

a power controller for calculating a load ratio change between current input data and previous input data stored in the first memory, comparing the calculated load ratio change with the predetermined number of threshold values to determine the brightness control speed which is the time for applying a new brightness value, and outputting the sustain information matched with the load ratio at the determined brightness control speed; and a video data processor for correcting and outputting the video signals.

15. An automatic power control method for a plasma display panel including a plurality of address electrodes and a plurality of scan electrodes and sustain electrodes alternately arranged in pairs, comprising:

separating all load ratios into a predetermined number of sections, allocating different brightness control speeds to the sections, and storing the brightness control speeds in a table;

calculating a load ratio of current input data;

determining to what section the calculated load ratio belongs, and determining the brightness control speed which is a time for applying a new brightness value, the brightness control speed being determined according to the section to which the load ratio belongs; and outputting sustain pulse information matched with the load ratio of current data at the determined brightness control speed.

16. The automatic power control method of claim 15, wherein separating all load ratios into a predetermined number of sections comprises: making the brightness control speed faster as the load ratio goes to a higher section, and making it slower as the load ratio goes to a lower section.

17. The automatic power control method of claim 15, further comprising: respectively generating sustain pulses and scan pulses matched with the sustain pulse information, and applying the sustain pulses and the scan pulses to the sustain electrodes and the scan electrodes.

18. An automatic power control device for a plasma display panel including a plurality of address electrodes and a plurality of scan electrodes and sustain electrodes alternately arranged in pairs, comprising:

a memory for separating all load ratios into a plurality of sections, determining a different brightness control speed, to each section, which is a time for applying a new brightness value according to the load ratio for each section, and storing the same;

an average signal level sensor for measuring a load ratio of externally input video signals; and a power controller for determining a brightness control speed depending on the load ratio of current input data with reference to the data stored in the memory, and outputting sustain information matched with the current load ratio at the determined brightness control speed.

19. The automatic power control device of claim 18, wherein the brightness control speed stored in the memory becomes faster as the load ratio moves to a section of high load ratio, and becomes slower as the load ratio moves to a section of low load ratio.

20. The automatic power control device of claim 19, wherein the brightness control speed separates all load ratios into four sections so that a curve of time versus power consumption may have three inflection points.

21. A plasma display panel device comprising:

a plasma display panel including a plurality of address electrodes, and a plurality of scan electrodes and sustain electrodes alternately arranged in pairs;

a controller for correcting and outputting external video signals, separating all load ratio changes into a predetermined number of sections, determining a different brightness control speed for each separated section, storing the same, determining to what stage the load ratio of the current input video signals belongs to determine a brightness control signal which is a time for applying a new brightness value according to the load ratio, and outputting sustain pulse information matched with the load ratio of the current data at the determined brightness control speed;

an address data generator for generating address data matched with the correction data output by the controller, and applying them to the address electrodes of the plasma display panel; and a sustain scan pulse generator for respectively generating sustain pulses and scan pulses matched with sustain information from the controller, and applying the sustain pulses and scan pulses to the sustain electrodes and the scan electrodes.

22. The plasma display panel device of claim 21, wherein the controller comprises:

a memory for separating all load ratios into a plurality of sections, determining a different brightness control speed, to each section, which is time information for applying a new brightness value according to the load ratio for each section, and storing the same;

an average signal level sensor for measuring the load ratio of externally input video signals; and the power controller for determining a brightness control speed depending on the load ratio of the current input data with reference to the data stored in the memory, and outputting the sustain information matched with the current load ratio at the determined brightness control speed.

23. A computer-readable medium having computer-executable instructions for performing a method of automatic power control for a plasma display panel, comprising:

calculating a load ratio change between current input data and previous input data;

comparing the calculated load ratio change with a predetermined number of threshold values to determine to which area it belongs;

determining a brightness control speed which is a time for applying a new brightness value matched with the determined area; and outputting sustain pulse information corresponding to the load ratio of current data at the determined brightness control speed.

24. The computer-readable medium of claim 23, with calculating the load ratio change comprises: separating the current input data into a plurality of blocks, calculating a load ratio change for each block, and adding the calculated load ratio changes.

25. A computer-readable medium having stored thereon a data structure of an automatic power control method for a plasma display panel, comprising:

a first field containing data representing separating all load ratios into a predetermined number of sections, allocating different brightness control speeds to the sections, and storing the brightness control speeds in a table;

a second field containing data representing calculating a load ratio of current input data;

a third field containing data representing determining to what section the calculated load ratio belongs, and determining a brightness control speed which is a time for applying a new brightness value, the brightness control speed being determined according to the section to which the load ratio belongs; and a fourth field containing data representing outputting sustain pulse information matched with the load ratio of current data at the determined brightness control speed.

* * * * *